US008056715B2

(12) United States Patent
Conklin

(10) Patent No.: US 8,056,715 B2
(45) Date of Patent: Nov. 15, 2011

(54) PORTABLE DISPENSERS FOR ARTICLES

(76) Inventor: William M. Conklin, Traverse City, MI (US)

( * ) Notice: Subject to any disclaimer, the term of this patent is extended or adjusted under 35 U.S.C. 154(b) by 0 days.

(21) Appl. No.: 12/393,013

(22) Filed: Feb. 25, 2009

(65) Prior Publication Data

US 2009/0152146 A1 Jun. 18, 2009

Related U.S. Application Data

(63) Continuation-in-part of application No. 11/277,244, filed on Mar. 23, 2006, now Pat. No. 7,721,885, which is a continuation-in-part of application No. 10/446,642, filed on May 28, 2003, now Pat. No. 7,032,748.

(51) Int. Cl.
*B65D 85/24* (2006.01)

(52) U.S. Cl. ..... 206/338; 206/349; 224/904; 224/240; 224/245

(58) Field of Classification Search ..... 206/338, 206/373, 372, 340, 374, 349; 30/136.5, 1.5, 30/298.4; 211/303, 309, 197; 224/240, 245, 224/673, 904

See application file for complete search history.

(56) References Cited

U.S. PATENT DOCUMENTS

| | | | | | |
|---|---|---|---|---|---|
| 1,566,195 | A | * | 12/1925 | Gandrau | 24/10 A |
| 2,654,130 | A | * | 10/1953 | Lundberg | 24/10 R |
| 2,758,798 | A | * | 8/1956 | Schmidt | 206/234 |
| 3,597,802 | A | * | 8/1971 | White | 24/91 |
| 4,189,048 | A | * | 2/1980 | Gaillard | 206/37 |
| 4,479,584 | A | * | 10/1984 | Raz | 211/89.01 |
| 5,547,115 | A | * | 8/1996 | Ambrosius et al. | 224/240 |

* cited by examiner

*Primary Examiner* — Mickey Yu
*Assistant Examiner* — Chun Cheung
(74) *Attorney, Agent, or Firm* — Weiner & Burt, P.C.; Irving M. Weiner; Pamela S. Burt

(57) ABSTRACT

Portable dispensers of nail strips, coils of roofing mails, roof staples, sheathing staples, welding rods, roofing nails, cartridge holders for diagonal nails which are put in a cartridge nail gun, framing nails, and the like.

1 Claim, 16 Drawing Sheets

FIG. 1
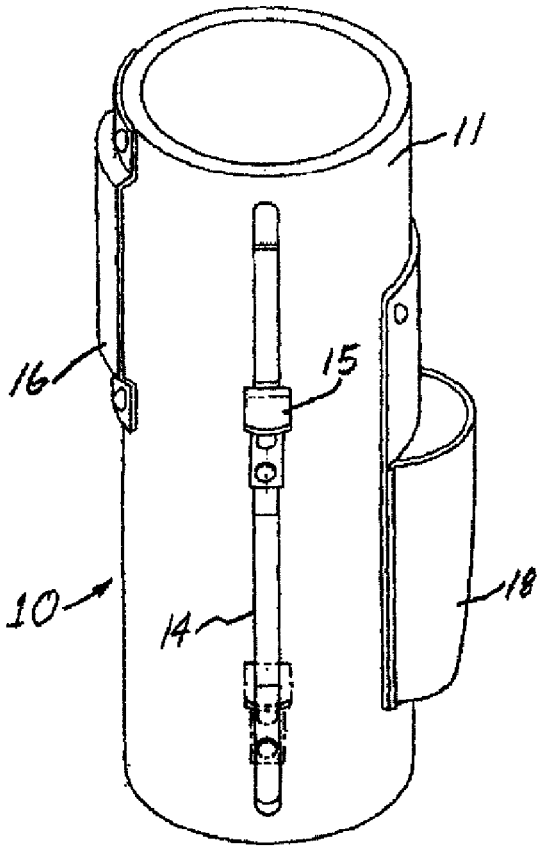
FIG. 3
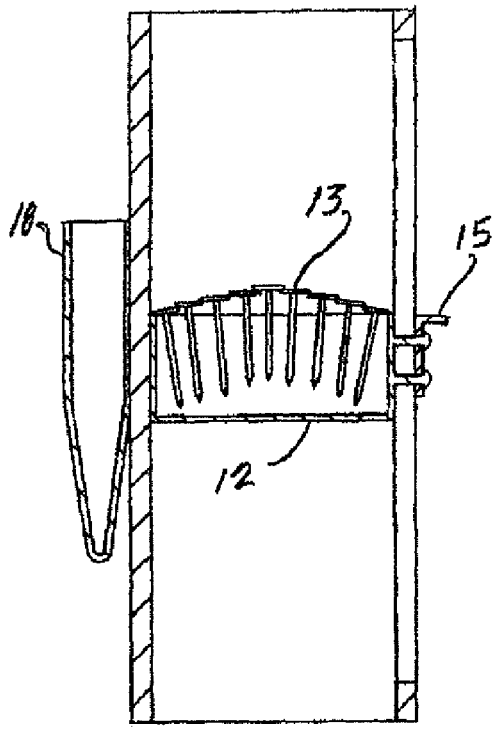
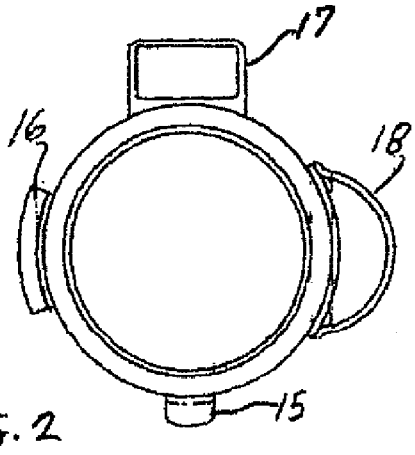
FIG. 2
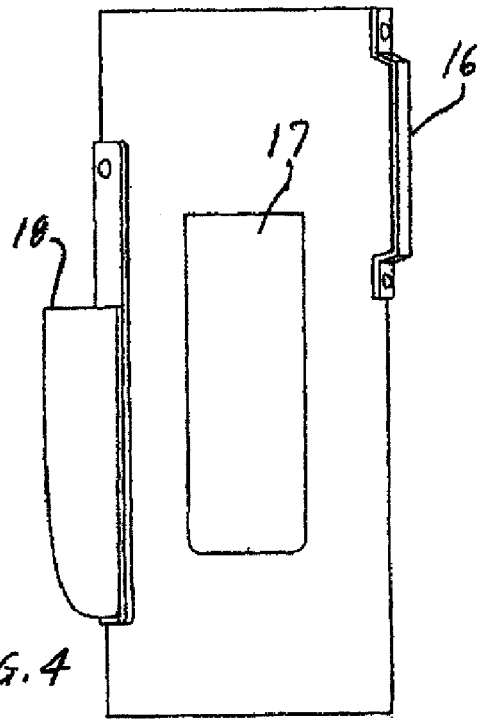
FIG. 4

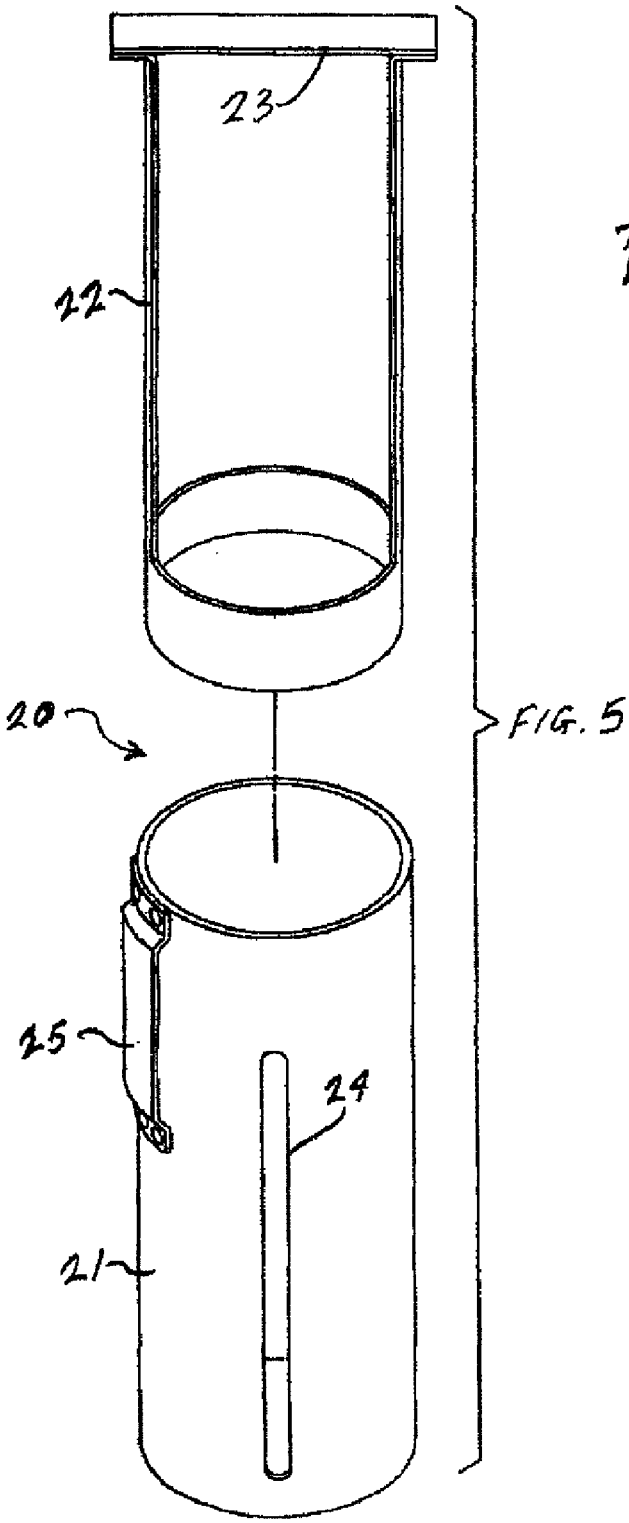
FIG. 5
FIG. 6
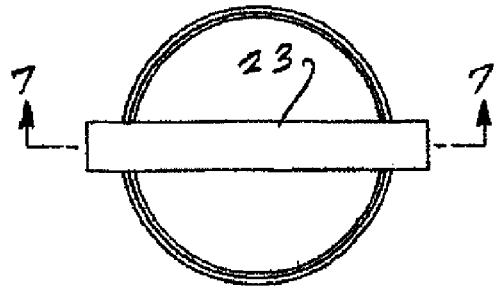
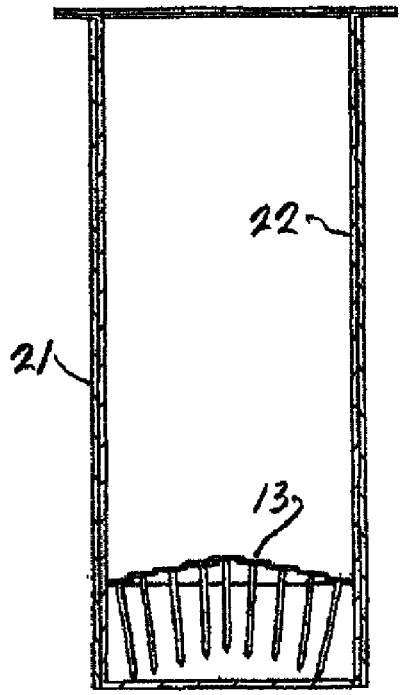
FIG. 7

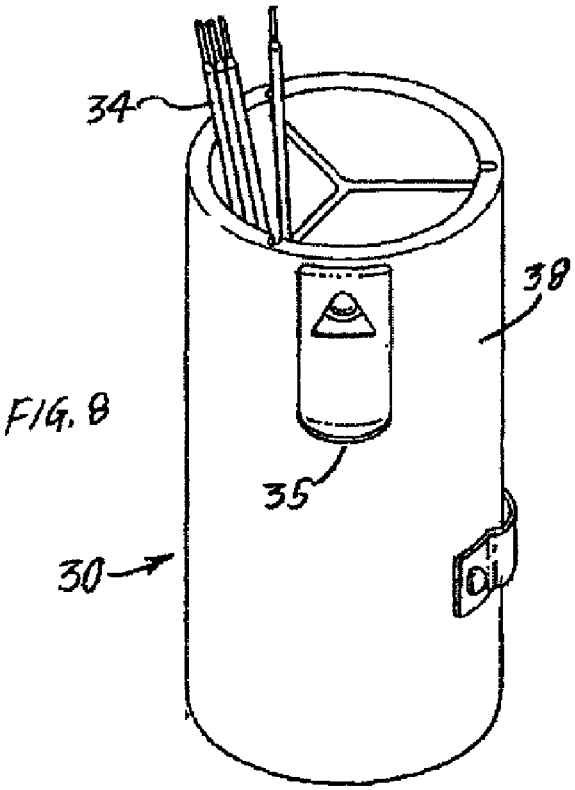
FIG. 8
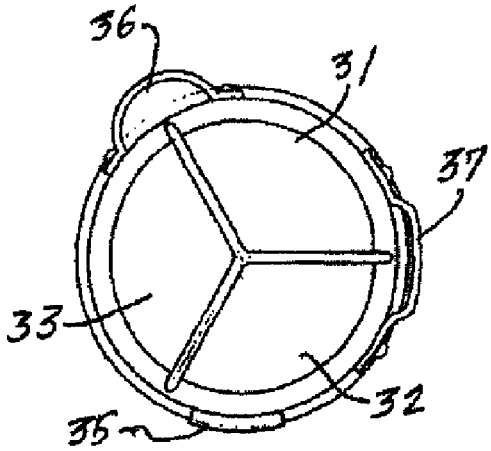
FIG. 10
FIG. 9
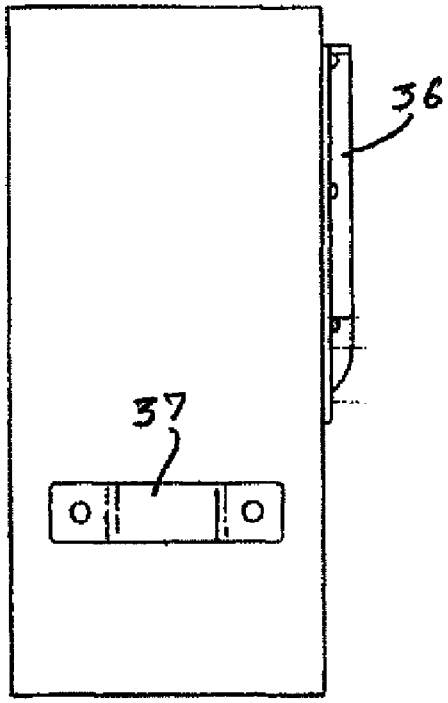
FIG. 11
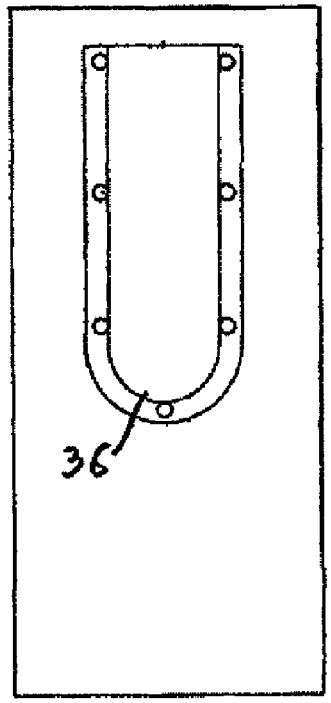

FIG. 24
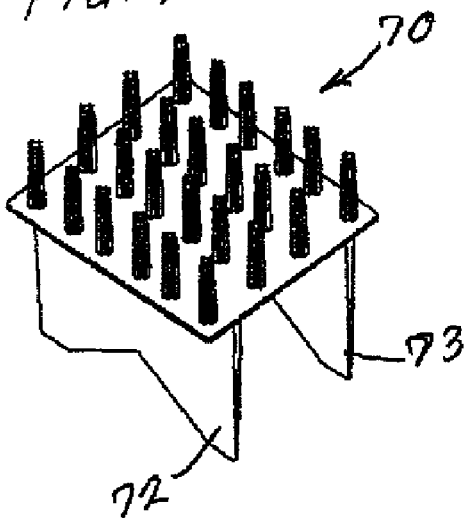
FIG. 26
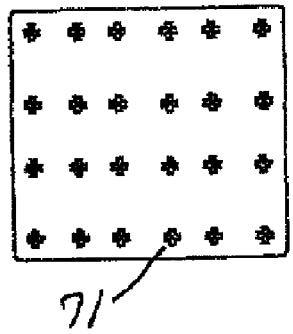
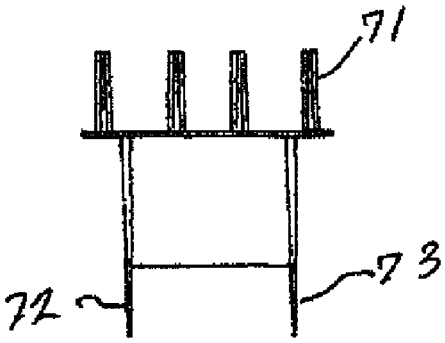
FIG. 25
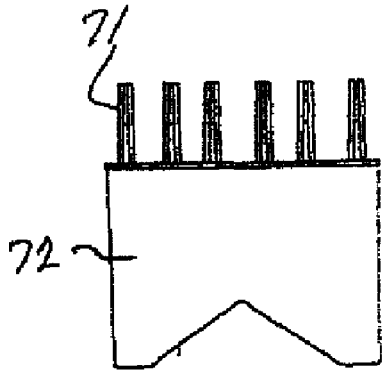
FIG. 27

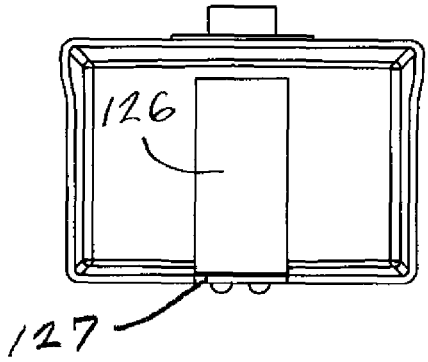
FIG 40
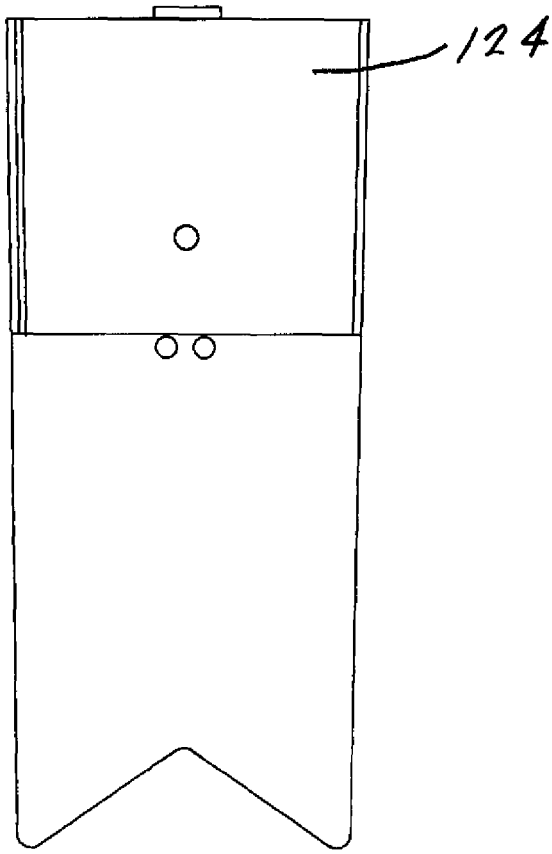
FIG 41
FIG 42
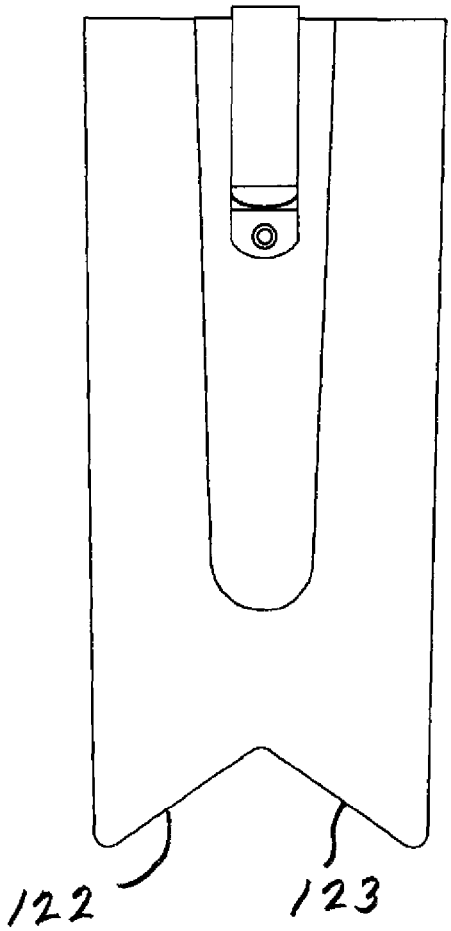
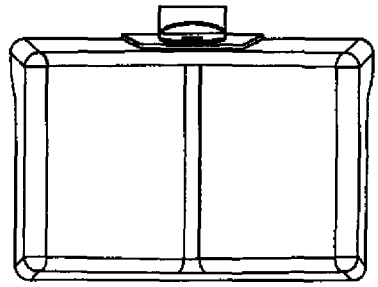
FIG 43

PORTABLE DISPENSERS FOR ARTICLES

This application is a continuation-in-part of U.S. patent application Ser. No. 11/277,244 filed Mar. 23, 2006 now U.S. Pat. No. 7,721,885, which in turn is a continuation-in-part of U.S. patent application Ser. No. 10/446,642, filed May 28, 2003 now U.S. Pat. No. 7,032,748.

The present invention relates generally to portable dispensers for temporarily holding and presenting a plurality of articles.

More particularly, the present invention relates to portable dispensers of coiled roofing nails, nail strips, roof staples, sheathing staples, welding rods, roofing nails, cartridge holders for diagonal nails which are put in a cartridge nail gun, framing nails, trim nails, and the like.

BACKGROUND OF THE INVENTION

Tradesmen and other persons working in the construction field, such as roofers and welders, require their equipment and supplies to be readily accessible and portable.

The prior art is exemplified by: Stuart et al. U.S. Pat. No. 2,555,380; Jeanfavre U.S. Pat. 3,390,761; Bader U.S. Pat. No. 3,485,354; Leedy U.S. Pat. No. 3,831,743; Dallas et al. U.S. Pat. No. 5,020,663; and Letson US Design Patent 404,199.

It is a desideratum of the present invention to provide novel and unique portable dispensers for a plurality of articles, while avoiding the animadversions of the prior art and conventional dispensers.

SUMMARY OF THE INVENTION

The present invention provides a portable dispenser for a plurality of articles, comprising: an open top container provided with first means therein for temporarily holding said plurality of articles and for making said plurality of articles readily accessible to a user of said portable dispenser; and second means provided on a first exterior surface of said open top container for removably and selectively attaching said portable dispenser to a belt of said user of said portable dispenser.

The present invention also provides a portable dispenser for a plurality of coiled fastening members, comprising: an open top container; first means disposed in said open top container for releasably holding said plurality of coiled fastening members in said open top container, and for making said plurality of coiled fastening members readily accessible to a user of said portable dispenser; said first means comprises a ribbed or fluted elongated member projecting from a bottom surface of said open top container along the central elongated major axis of said open top container; and second means provided on a first exterior surface of said open top container for removably and selectively attaching said portable dispenser to a belt of said user of said portable dispenser.

The present invention further provides a portable dispenser for a plurality of strips of fastening members, comprising: an open top container; first means disposed in said open top container for releasably holding said plurality of rod-shaped articles in said open top container, and for making said plurality of rod-shaped articles readily accessible to a user of said portable dispenser; said first means comprises a leaf spring affixed at one, and only one, end thereof to said open top container; and second means provided on a first exterior surface of said open top container for removably and selectively attaching said portable dispenser to a belt of said user of said portable dispenser.

One object of the present invention is to provide a portable dispenser as described hereinabove, wherein the dispenser is substantially cylindrical in shape and holds coiled roofing nails in a stack of six to eight coils.

Another object of the present invention is to provide a portable dispenser as described hereinabove, wherein the dispenser is designed to hold coiled roofing nails so that they will not uncoil and remain whole.

A further object of the present invention is to provide a portable dispenser as described hereinabove, wherein the dispenser is secured on the belt of the user of the dispenser so as to be accessible with one hand of the user while holding a nail gun with the other hand, thus readily enabling the retrieving of nails on the move.

Yet a further object of the present invention is to provide portable dispensers as described hereinabove, wherein the dispenser may be attached to the roofer's belt and which allows for quick and easy access to the coils of roofing nails from the top of the dispenser.

An additional object of the present invention is to provide a portable dispenser as described hereinabove, wherein the dispenser can be used for holding welding rods therein.

Another object of the present invention is to provide a portable dispenser as described hereinabove, wherein there is provided on the exterior of the dispenser means for holding soapstone.

Further objects, advantages and features of the present invention will become apparent to those persons skilled in this particular area of technology and to others after being exposed to the following detailed specification and accompanying drawings.

BRIEF DESCRIPTION OF THE DRAWINGS

FIG. 1 is a perspective view of a portable dispenser in accordance with a first embodiment of the present invention.

FIG. 2 is a top view of the FIG. 1 embodiment.

FIG. 3 depicts a vertical cross-sectional view of the FIG. 1 embodiment.

FIG. 4 illustrates a vertical elevational view of the FIG. 1 embodiment.

FIG. 5 illustrates a perspective view of a portable dispenser in accordance with a second embodiment of the present invention.

FIG. 6 depicts a top view of the FIG. 5 embodiment.

FIG. 7 illustrates a vertical cross-sectional view taken along the line 7-7 shown in FIG. 6.

FIG. 8 illustrates a perspective view of a portable dispenser in accordance with a third embodiment of the present invention.

FIG. 9 depicts an elevational view taken from one side of the FIG. 8 embodiment.

FIG. 10 depicts a top plan view of the FIG. 8 embodiment.

FIG. 11 illustrates an elevational view taken from another side of the FIG. 8 embodiment.

FIG. 24 depicts a perspective view of a staple holder unit structure which may be used in conjunction with the embodiment illustrated in FIG. 20-23.

FIG. 25 illustrates a front elevational view of the FIG. 24 structure.

FIG. 26 depicts a top plan view of the FIG. 24 structure.

FIG. 27 illustrates a side elevational view of the FIG. 24 structure.

FIGS. 37-43 show another embodiment.

DETAILED DESCRIPTION OF SOME PREFERRED EMBODIMENTS OF THE PRESENT INVENTION

Figure 12:
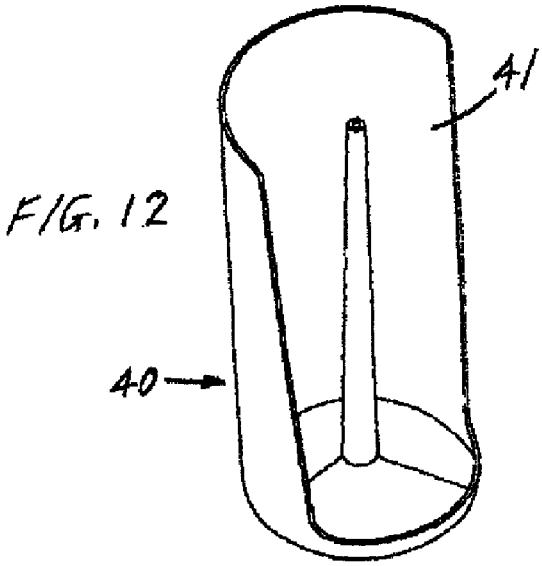
FIG. 12 depicts a perspective view of a portable dispenser in accordance with a fourth embodiment of the present invention.

FIGS. 1-4 illustrate a portable dispenser 10 according to a first embodiment of the present invention.

The portable dispenser 10 comprises an open top container 11 provided with first means therein, such as a sliding disc or other structure 12, upon which may be stacked several coils of roofing nails 13. One such coil of roofing nails 13 is shown for illustration in FIG. 3.

The open top container 11 is provided with a longitudinal groove 14 within which is slidably positioned a thumb lever device 15 which is attached to the sliding disc 12. The thumb lever device 15 is shown in phantom line at the bottom of FIG. 1, and is also shown in an elevated position in the upper central portion of FIG. 1. The user of the dispenser 10 merely hooks his thumb under the thumb lever device 15 and raises the sliding disc 12 with the coils of roofing nails 13 thereon by sliding it in the groove 14 until the coil of roofing nails 13 is accessible to the user near the open top of the container 11. Upon taking an uppermost coil of roofing nails 13, the disc 12 then slides down and returns to its lowermost position.

The dispenser 10 is provided with second means, in the form of a belt loop device 16, through which the belt of the user may be placed so that the portable dispenser 10 may be removably attached to the belt of the user.

The portable dispenser 10 may also be provided with a knife holder 17 for holding a knife for cutting roof shingles, and a sheath 18 for holding a snips tool.

The portable dispenser 10 illustrated in FIGS. 1-4 is dimensioned to hold six to eight coils of roofing nails 13.

FIGS. 5-7 illustrate a portable dispenser 20 according to a second embodiment of the present invention.

The portable dispenser 20 comprises an open top container 21 within which a second container 22 is slidably disposed. Six to eight coils of roofing nails 13 may be held in the second container 22. For illustration purposes, a coil of roofing nails 13 is shown in the second container 22 in FIG. 7.

The second slidable container 22 is provided with gripping means, such as a handle 23, at the top end of the second container 22 to enable the user to move the second slidable container 22 upwardly to gain access to the topmost of the coils of roofing nails 13.

The open top container 21 is provided with a longitudinal groove 24 to enable the user to readily see at a glance how many coils of roofing nails 13 are still left in the dispenser 20.

The dispenser is also provided with a belt loop device 25, similar to the device 16 shown in FIGS. 1-4.

FIGS. 8-11 illustrate a portable dispenser 30 according to a third embodiment of the present invention.

The portable dispenser 38 is provided with an open top container 38 having a plurality of compartments 31, 32 and 33 for temporarily holding a plurality of articles, such as welding rods 34, and for making the welding rods 34 readily accessible to the user of the portable dispenser.

The portable dispenser 30 is provided with a clip 35 to enable the dispenser 30 to be clipped on to the belt of the user. The dispenser 30 is also provided with a pocket 36 for holding soapstone and the like. In addition, the dispenser 30 is provided with a clip 37 upon which a tape measure may be removably held.

FIGS. 12-15 illustrate a portable dispenser 40 according to a fourth embodiment of the present invention.

The dispenser 40 is provided with a substantially semicylindrical open top container 41. From the bottom surface 42 of the open top container 41 there extends an elongated member 43 along the central elongated major axis of the open top container 41. A plurality of articles, such as a plurality of coils of roofing nails 13, may be readily placed on the elongated member 43 for temporarily holding same thereon.

Figure 14:
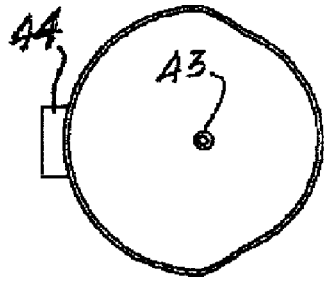
FIG. 14 illustrates a top plan view of the FIG. 12 embodiment.
Figure 13:
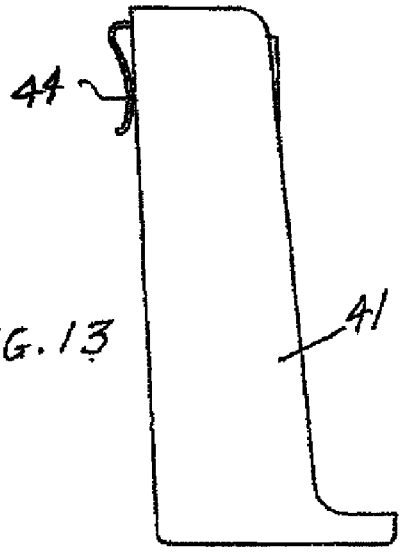
FIG. 13 depicts a side elevational view of the FIG. 12 embodiment.
Figure 15:
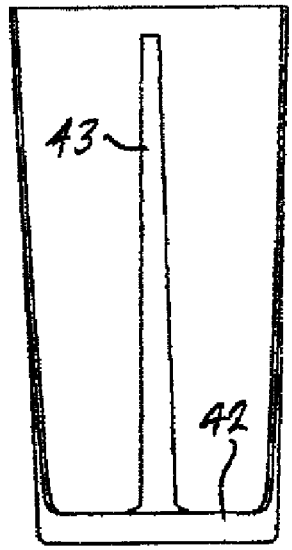
FIG. 15 illustrates an elevational view of the FIG. 12 embodiment facing the major opening in the side of the portable dispenser.
Figure 16:
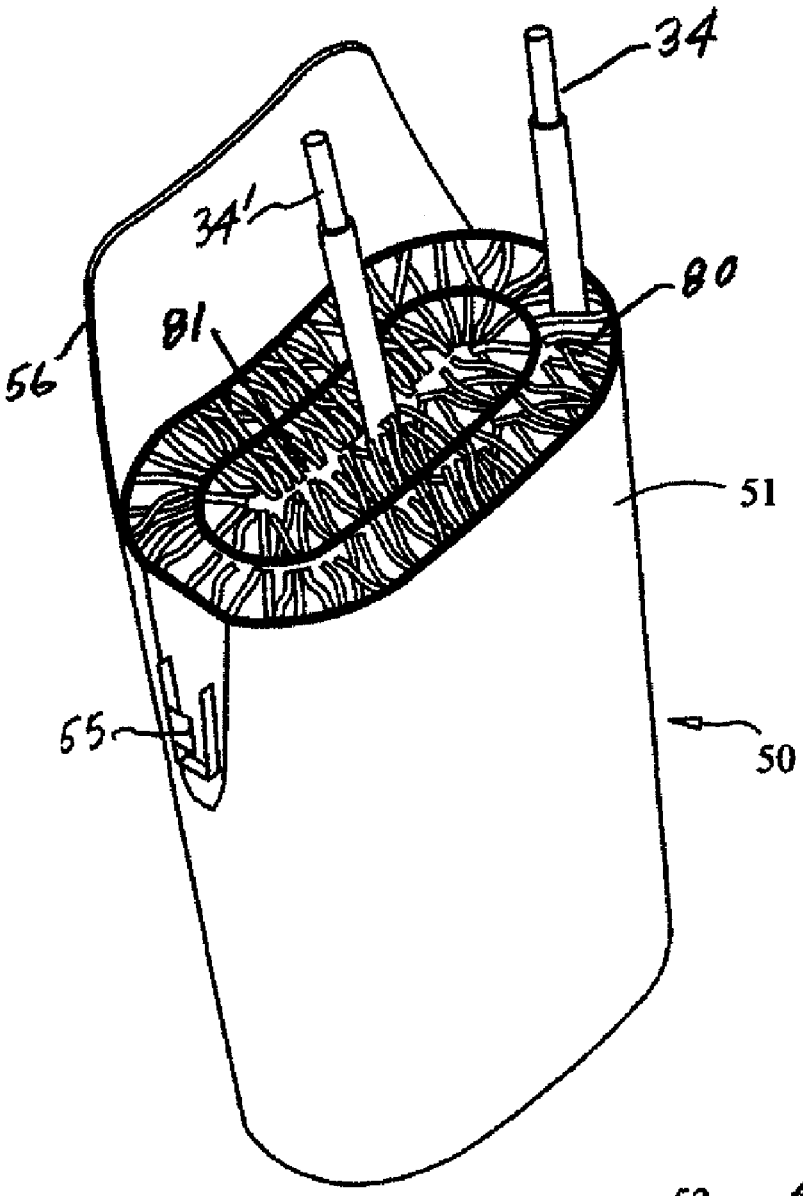
FIG. 16 depicts a perspective view of a portable dispenser in accordance with a fifth embodiment of the present invention.
Figure 18:
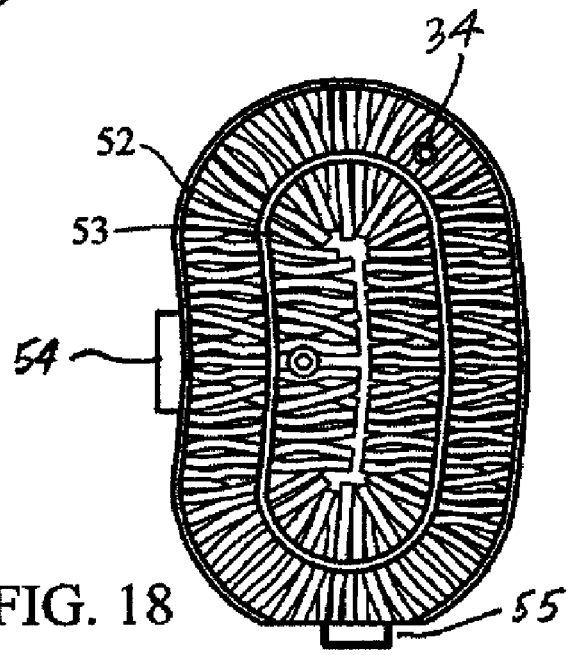
FIG. 18 illustrates a top plan view of the FIG. 16 embodiment.
Figures 17, 19:
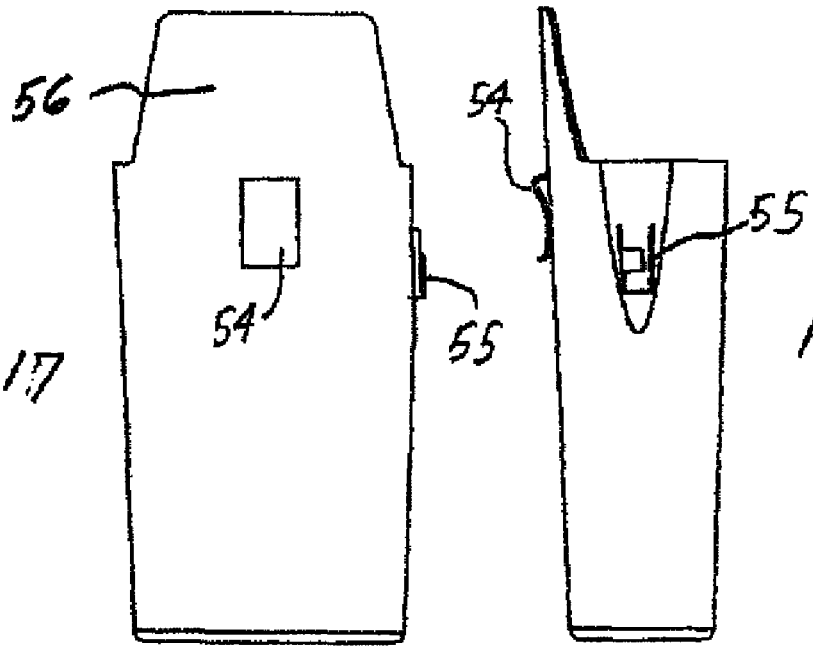
FIG. 17 illustrates an elevational view of the back of the FIG. 16 embodiment.
FIG. 19 depicts a side elevational view of the FIG. 16 embodiment.
Figure 20:
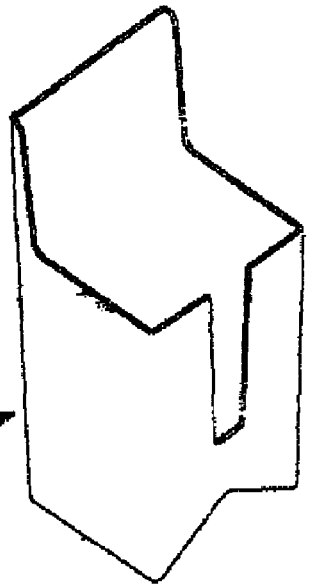
FIG. 20 illustrates a perspective view of a portable dispenser in accordance with a sixth embodiment of the present invention.
Figure 22:
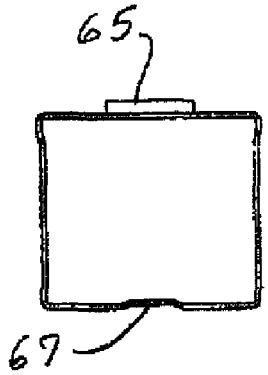
FIG. 22 illustrates a top plan view of the FIG. 20 embodiment.
Figure 21:
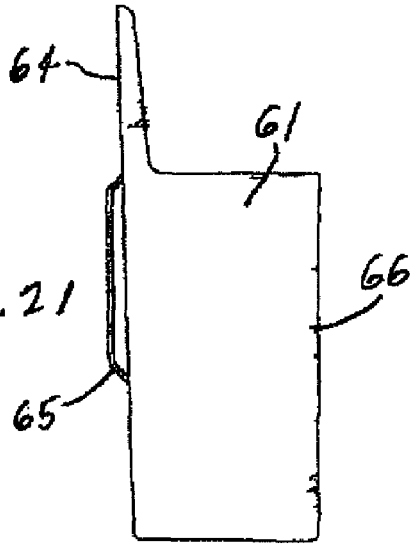
FIG. 21 depicts a side elevational view of the FIG. 20 embodiment.
Figure 23:
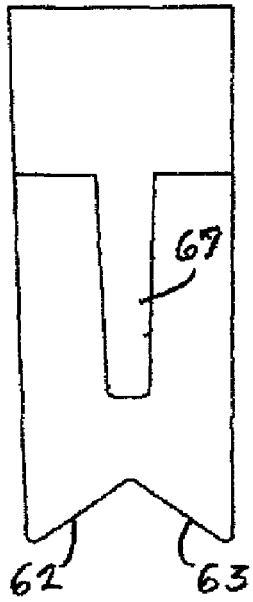
FIG. 23 illustrates a front elevational view of the FIG. 20 embodiment.

As shown in FIGS. 13 and 14, the portable dispenser 40 is provided with a clip 44 for removably holding the dispenser 40 on the belt of the user. Here again, the dispenser 40 may hold six to eight coils of roofing nails 13.

FIGS. 16-19 illustrate a portable dispenser 50 according to a fifth embodiment of the present invention.

The portable dispenser 50 comprises an open top container 51 for holding welding rods 34 and 34' therein. The dispenser 50 is provided with a first compartment 52 and a second compartment 53. The second compartment 53 surrounds the first compartment 52, is coaxial therewith, and is similarly shaped thereto.

The dispenser 50 is provided with a swivelable clip 54 to enable the dispenser 50 to be clipped onto the belt of the user. In addition, the dispenser 50 is provided with holding means 55 for removably holding a small article, such as soapstone and the like. The dispenser 50 has an upper guard portion 56 to protect the user from being stuck with the welding rods when the user is bending.

Retention means 80 and/or 81, such as Astroturf-type doormat material, is glued to the interior surface of compartments 52 and 53, respectively, to retain welding rods 34 and 34' in place even if dispenser 50 is dropped or tipped over.

FIGS. 20-23 illustrate a portable dispenser 60 according to a sixth embodiment of the present invention.

The portable dispenser 60 comprises an open top container 61 having a substantially rectangular cross section which is disposed substantially perpendicular to a vertical elongated axis of the container 61.

The open top container 61 has a bottom portion formed by two surfaces 62 and 63 disposed oblique to the vertical elongated axis of the container 61. The tallest surface 64 of the container 61 is provided with a loop device 65 through which the belt of the user may be passed for holding the dispenser 60 on the belt of the user.

A parallel opposite surface 66 of the container 61 is provided with an elongated notch 67 therein.

The portable dispenser 60 shown in FIGS. 20-23 is adapted to be used with the staple holder unit structure 70 illustrated in FIGS. 24-27.

With reference to FIGS. 24-27, there is shown a staple holder unit structure 70 for holding roof and/or sheathing staples 71.

The staple holder unit structure 70 is provided with members 72 and 73 which fit on and mate with the bottom portion of the embodiment illustrated in FIGS. 20-23.

It should be noted that the staples 71 may be arranged in rows and columns as illustrated in FIGS. 24-27 if desired.

Figure 28:
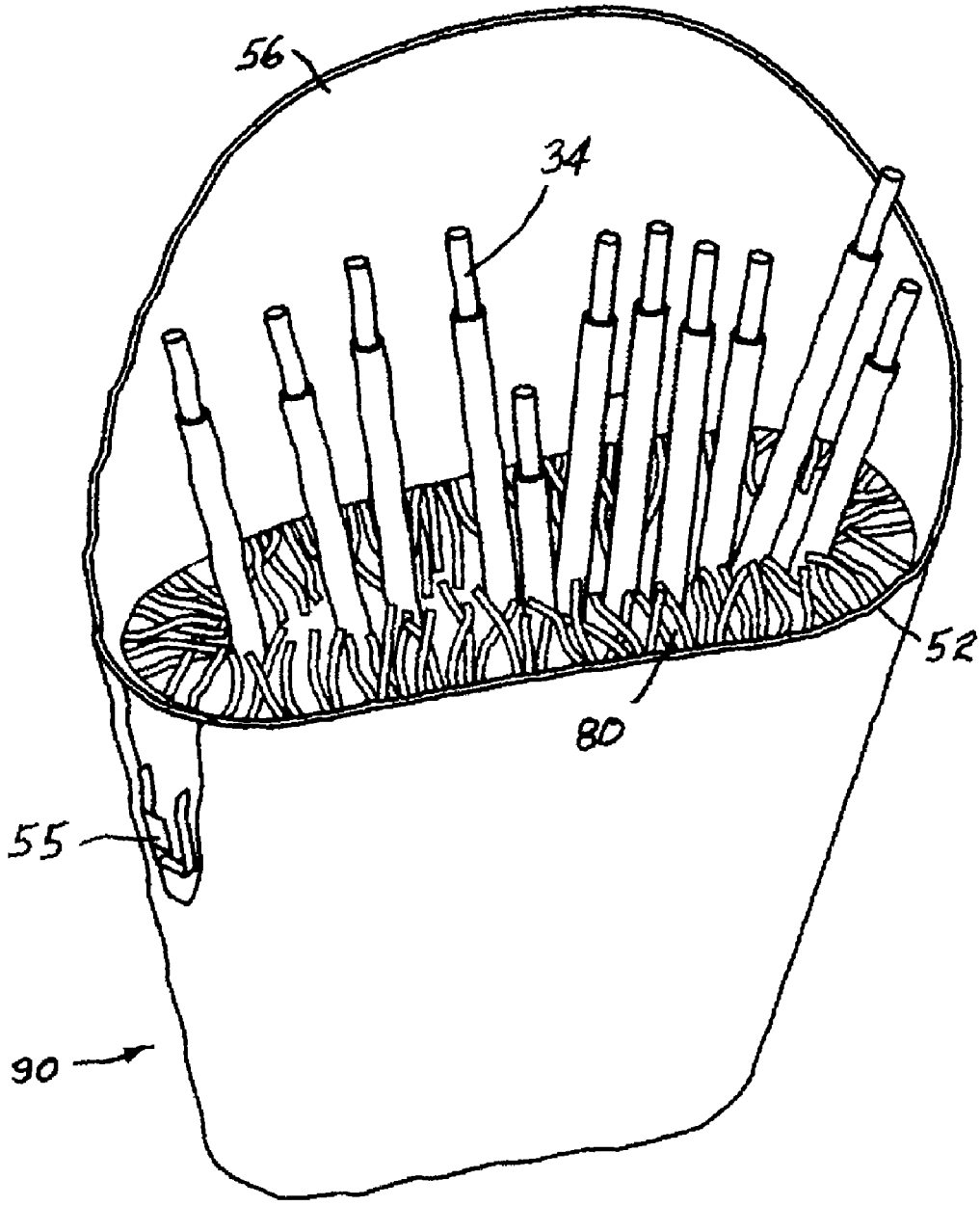
FIG. 28 shows another embodiment of the invention.

FIG. 28 shows a portable dispenser 90 which is somewhat similar to the embodiment depicted in FIGS. 16-19. Accordingly, some of the similar components of dispensers 50 and 90 use similar reference numerals.

Dispenser 90 is similar to dispenser 50, but dispenser 90 does not have a second or inner compartment 53. The singular compartment 52 of the dispenser 90 is provided with retention means 80 secured to the inner surface of the compartment 52 to be retained therein.

The dispenser 90 is also provided with a belt clip 54 (shown in FIGS. 17-19) which is hidden from view because it is provided on the side of the dispenser 90 away from the viewer toward the user of dispenser 90.

Figure 29:
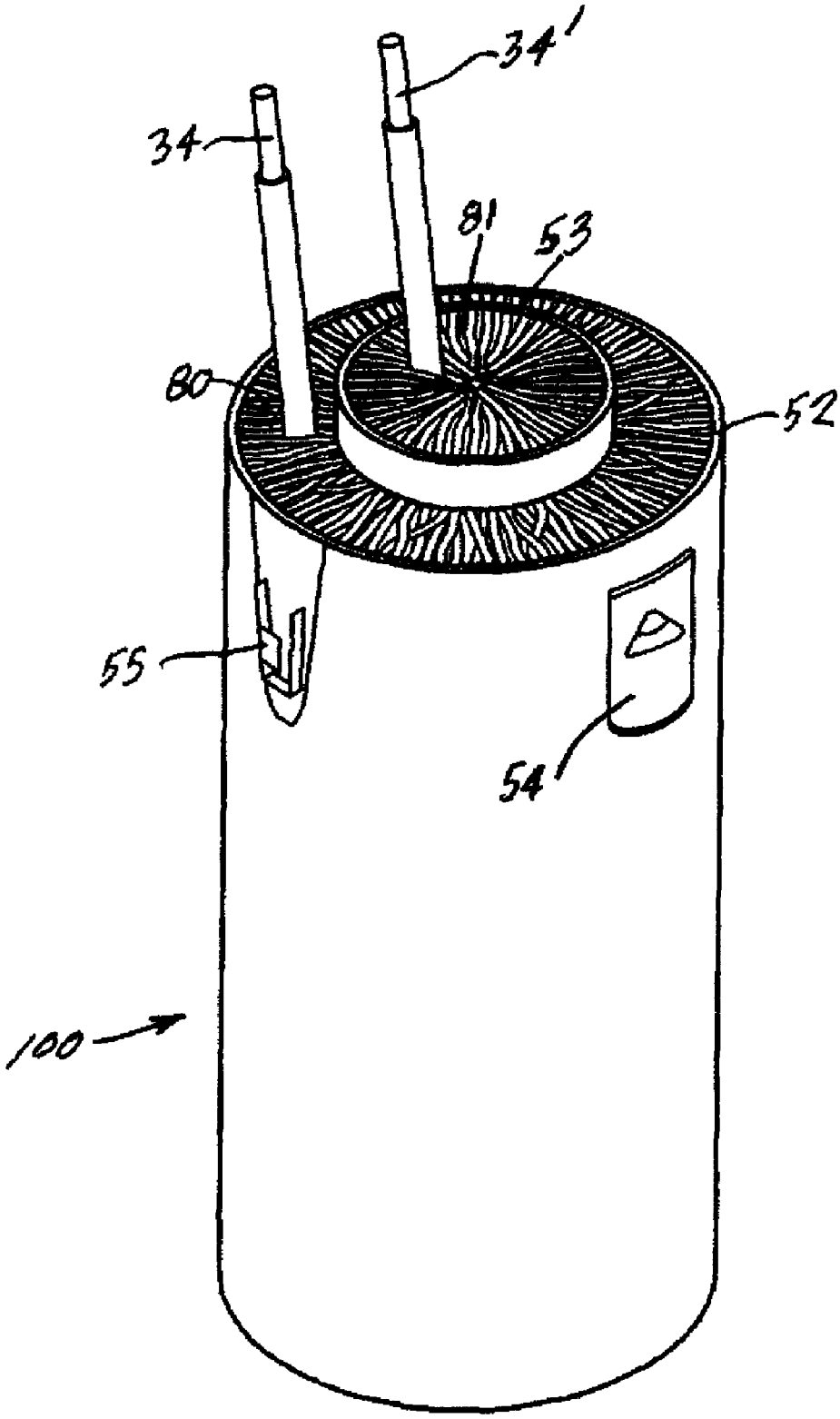
FIG. 29 depicts yet another embodiment of the invention.
Figure 30:
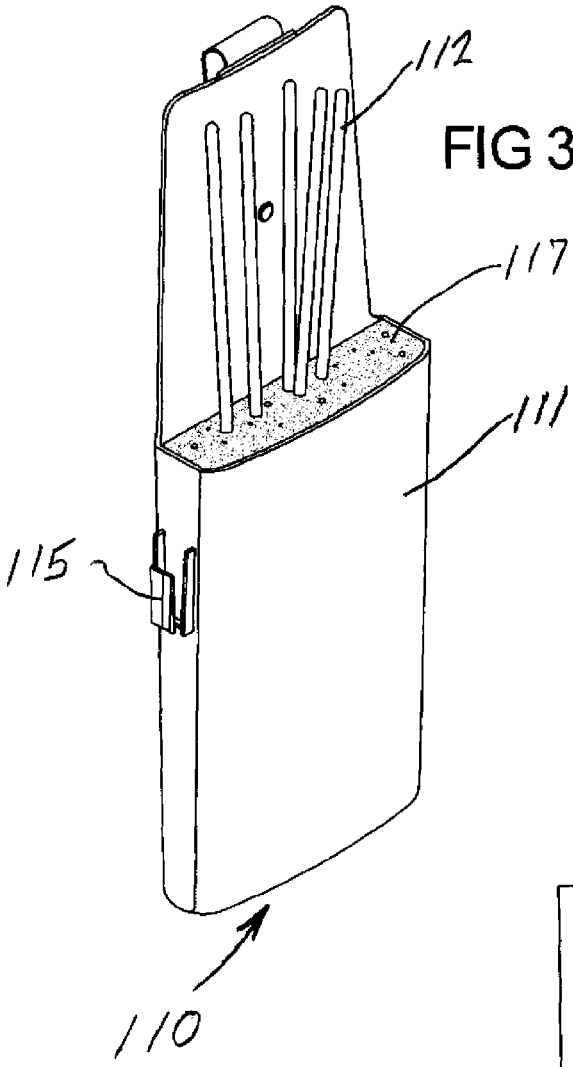
FIGS. 30-36 show another embodiment.
Figure 31:
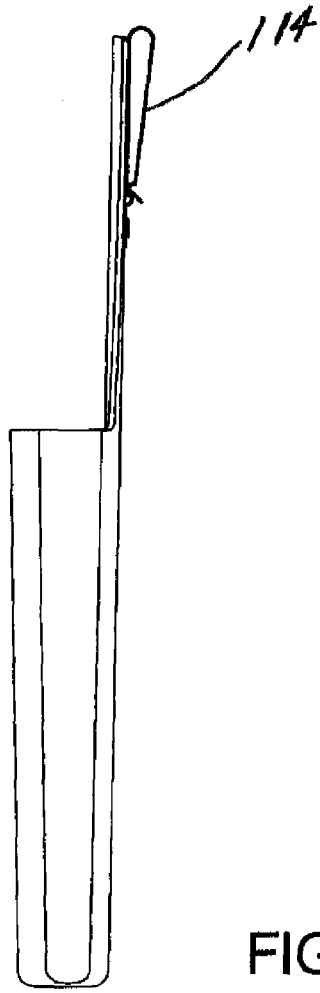

FIG. 29 shows another embodiment in the form of a dispenser 100 having a first compartment 52 and a second compartment 53. Dispenser 100 is also similar to the embodiment depicted in FIGS. 16-19, and accordingly similar reference numerals are used to designate similar components.

With respect to dispensers 50, 90 and 100, they are provided with retention means 80 or 81 which are glued along the interior surfaces of the dispensers and which function to retain the welding rods in place even in the dispenser is dropped or tipped over. The retention means 80 or 81 perform a very essential function. On the job and at the workplace, e.g. welding shops, it is not only desired to eliminate waste, but is also necessary to avoid safety hazards of falling welding rods from very high places such as structures which are 5, 10, 25, or 35 stories high. Steelworkers are fined the first time a welding rod is dropped, and are fired when a welding rod falls a second time on a particular job.

The retention means 80 or 81, such as for example, Astroturf-type doormat material, functions to hold the rods in place until the rods are actually pulled out by the worker. The present invention uses the Astroturf-type doormat material only as one example, but the present invention covers all functional alternative materials for the retention means.

With reference to the embodiments of the invention described hereinabove which hold coiled roofing nails 13, it should be noted that such coiled roofing nails 13 are held in a cylindrically-shaped dispenser so that they will remain whole and not uncoil. The dispenser may be secured to the belt of the roofer or other user so as to be accessible with one hand, while holding a nail gun in the other hand, thus retrieving the nails 13 on the move.

Preferably, but not necessarily, a four-inch diameter plastic portable dispenser will allow coiled one and one-quarter inch roofing nails 13 to be stacked on top of each other.

By attaching the portable dispenser to the roofer's belt, it permits for quick and easy access to the coils of roofing nails 13 from the top of the dispenser. Furthermore, by attaching knife and snip holders 17 and 18, the roofer can have all of his necessary tools at his fingertips, mounted on the outside of the portable dispenser.

FIGS. 30-36 illustrate a portable dispenser 110 according to another embodiment of the present invention.

The portable dispenser 110 comprises an open top container 111 for holding welding rods 112 therein. The dispenser 110 is provided with a single compartment 113.

The dispenser 110 is provided with a swivelable clip 114 to enable the dispenser 110 to be clipped onto the belt of the user. In addition, the dispenser 110 is provided with holding means 115 for removably holding a small article, such as soapstone and the like. The dispenser 110 has an upper guard member 116 to protect the user from being stuck with the welding rods when the user is bending.

Retention means 117, such as a synthetic turf material, is glued to the interior surface of and/or force fit into the compartment 113, to retain the welding rods 112 in place even if dispenser 110 is dropped or tipped over.

Retention means 117 can be fabricated from various types of plastics, such as, for example, polystyrene.

Figure 32:
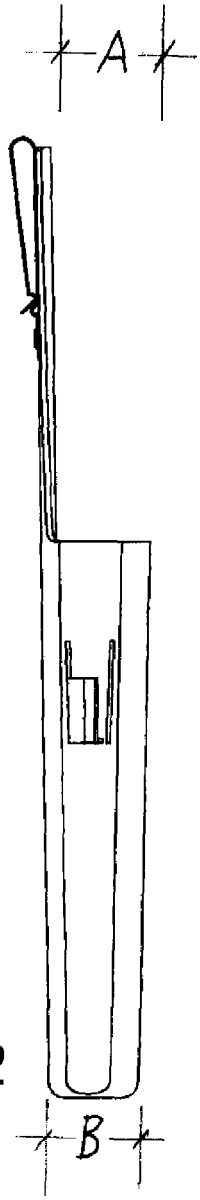
Figure 33:
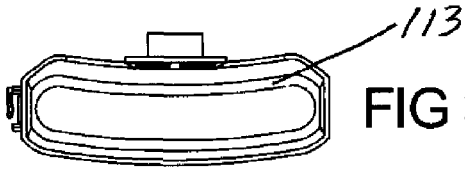

With reference to FIG. 32, dimension A is depth dimension of the top opening of compartment 113, and dimension B is the overall depth dimension of the bottom of device 110.

Figure 34:
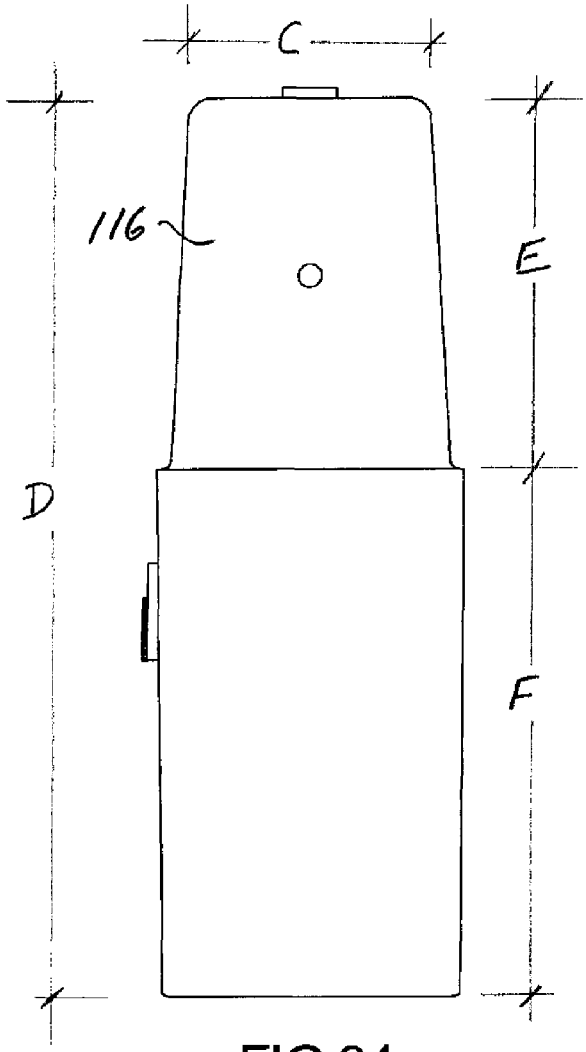
Figure 36:
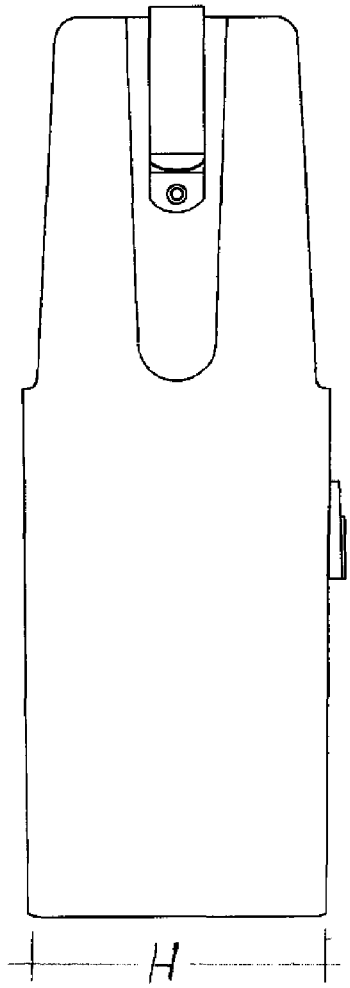
Figure 36:
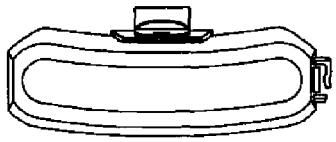
Figure 37:
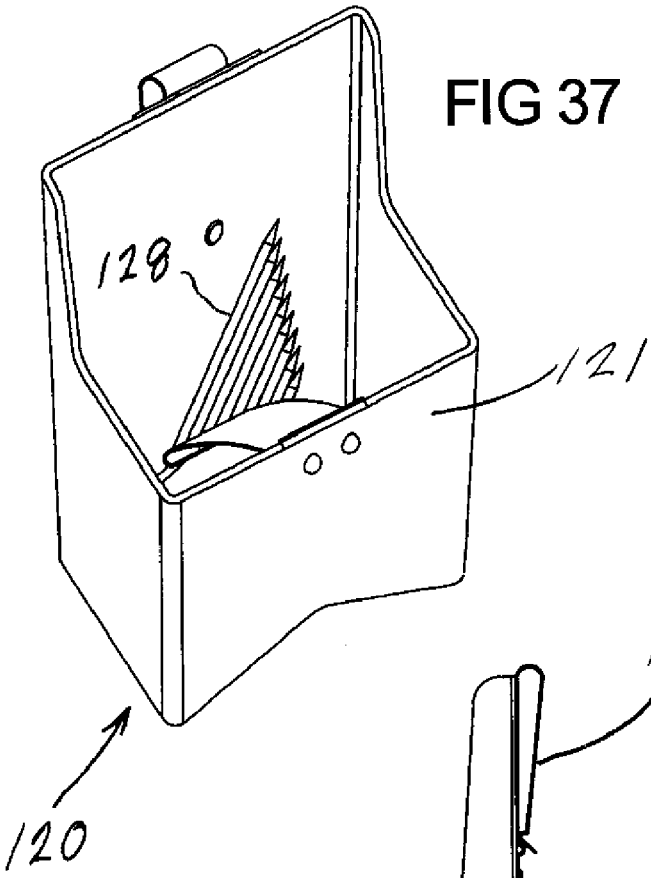
Figure 38:
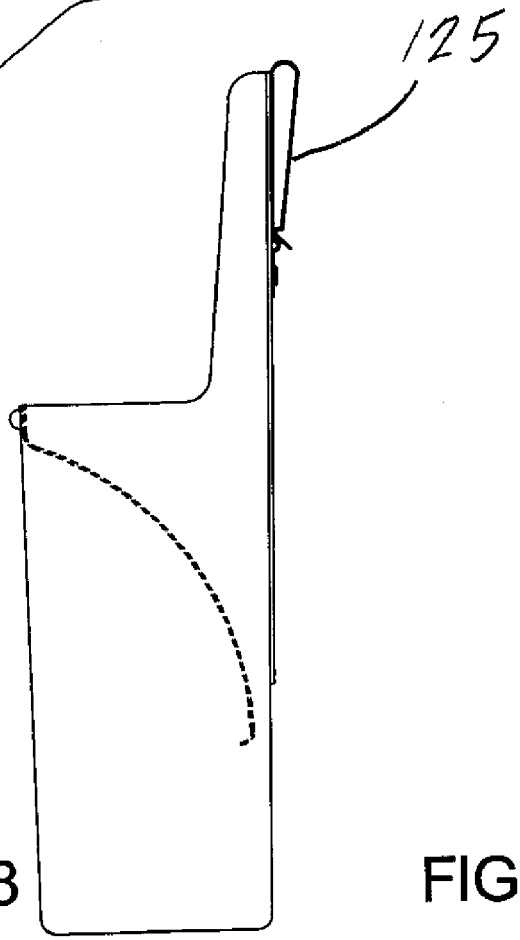
Figure 39:
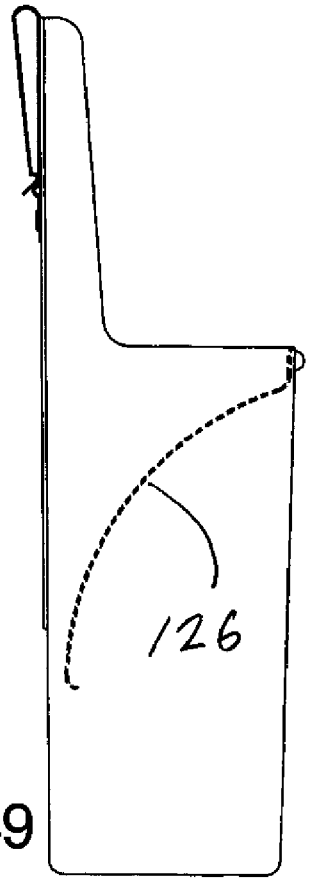
Figure 44:
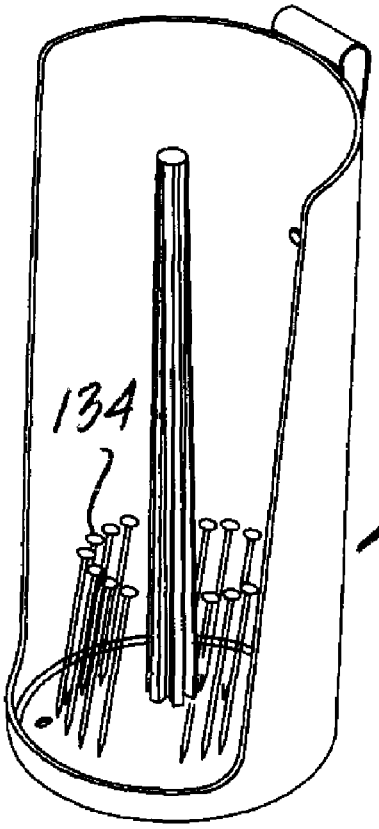
FIGS. 44-51 show another embodiment.

With reference to FIG. 34: dimension C is the width dimension of top part of guard member 116; dimension D is the overall vertical dimension of device 110; dimension E is the vertical dimension of guard member 116; and dimension F is the vertical dimension of compartment 113.

Figure 35:
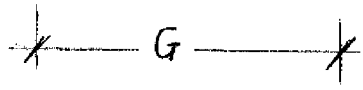

With reference to FIG. 35, dimension G is the overall width dimension of the top of compartment 113, and dimension H is the overall width dimension of the bottom of device 110.

After extensive experimentation, it has been determined that the in order to provide a device 110 which operates best in the field, it is important to select particular dimension for dimensions A-H. Preferably, but not necessarily, dimension A should be approximately 1.5 inches; dimension B should be approximately 1.18 inches; dimension C should be approximately 4.75 inches; dimension D should be approximately 14.5 inches; dimension E should be approximately 6 inches; dimension F should be approximately 8.5 inches; dimension G should be approximately 5.75 inches; and dimension H should be approximately 5.62 inches.

FIGS. 37-43 illustrate a portable dispenser 120 according to another embodiment of the present invention.

The portable dispenser 120 comprises an open top container 121 having a substantially rectangular cross section which is disposed substantially perpendicular to a vertical elongated axis of the container 121.

The open top container 121 has a bottom portion formed by two surfaces 122 and 123 disposed oblique to the vertical elongated axis of the container 121. The tallest surface 124 of the container 121 is provided with a loop device or clip device 125 for use with the belt of the user for holding the dispenser 120 on the belt of the user.

A steel spring 126 is fastened at one end 127 thereof to the container 121. The spring 126 provides releasable retention in container 121 for various sizes and types of fastening members 128, such as framing nails, finish carpentry nails, plywood nails, sheeting nails, OSB nails, strip nails, screws, rivets, etc.

This embodiment provides a portable dispenser for strips of plastic collated nails arranged in a parallelogram so that the nails are parallel to each other with all nail points lying in one side of said parallelogram, comprising: an open-topped container provided with a single unitary leaf spring to temporarily hold at least one strip of said collated nails and to make said strip of said collated nails readily accessible to a user of said portable dispenser; a clip provided on an exterior surface of a back member of said open-topped container to removably and selectively temporarily attach said portable dispenser to a belt of the user of said portable dispenser; said open-topped container has a substantially rectangular cross-section which is disposed substantially perpendicularly to a central vertical elongated axis of said open-topped container; said open-topped container has a closed bottom formed by two bottom members disposed oblique to said central vertical elongated axis of said open-topped container and disposed at an angle relative to each other; said open-topped container includes a front member which, is parallel to and opposite to said back member of said open-topped container; said front member and said back member each have a concave obtuse angle formed therein by said two oblique bottom members; said portable dispenser includes identical right and left side members which interconnect said front member and said back member; said portable dispenser is symmetrical relative to a plane disposed perpendicular to said front and back members and containing said central vertical elongated axis; each said bottom member is angled in only one plane relative to said plane disposed perpendicular to said front and back members and containing said central vertical elongated axis; said portable dispenser being designed, dimensioned and constructed so that each said strip of plastic collated nails is disposed completely within said open-topped container and is contiguous with one of said two oblique bottom members at the selection of the user to make the nails readily accessible to either desired hand of the user and from any desired position of said portable dispenser clipped to the belt of the user; said single unitary leaf spring is affixed at one, and only one, end thereof at an upper edge of said front member of said portable dispenser; said single unitary leaf spring is disposed near a central portion of said open-topped container and is positioned to temporarily hold all of said strips of plastic collated nails completely within said open-topped container; and said front member, said back member, and said two oblique bottom members have lowermost edges which are disposed in a common plane that is oriented perpendicular to said plane disposed perpendicular to said front and back members and containing said central vertical elongated axis to enable said portable dispenser to stand upright unassisted on an external horizontal surface without tipping over.

FIGS. 44-51 illustrate a portable dispenser 130 according to another embodiment of the present invention.

The dispenser 130 is provided with a substantially semi-cylindrical open top container 131. From the bottom surface 132 of the open top container 131 there extends an elongated ribbed or fluted member 133 along the central elongated major axis of the open top container 131. A plurality of articles, such as a plurality of coils of roofing nails 134, may be readily placed on the elongated member 133 for temporarily holding same thereon.

Figure 51:
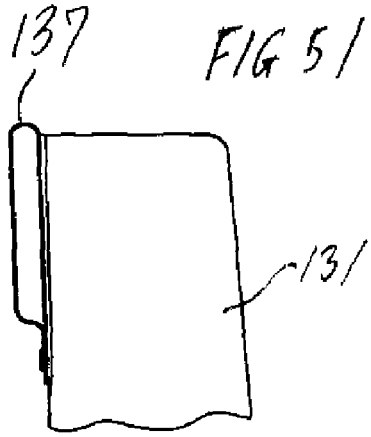
Figure 45:
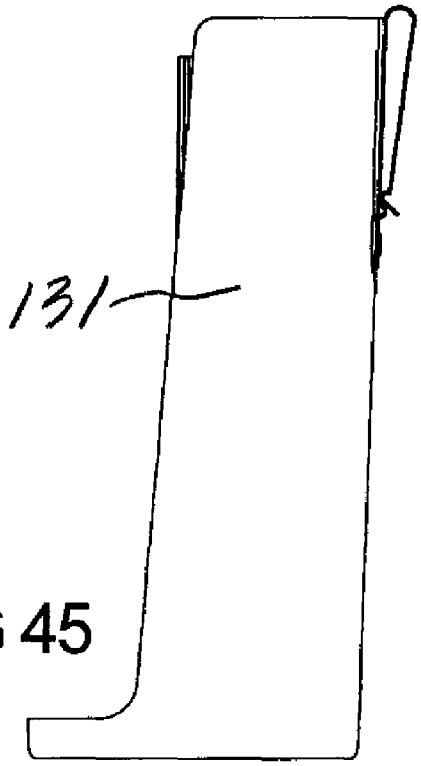
Figure 46:
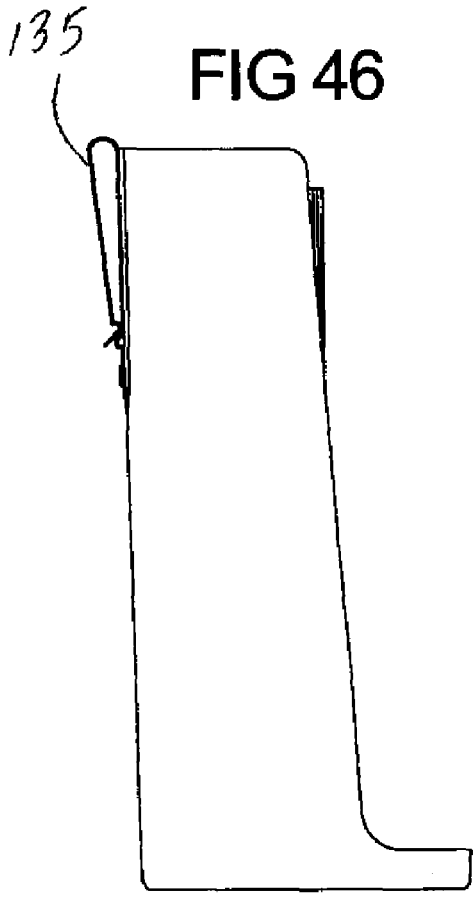
Figure 47:
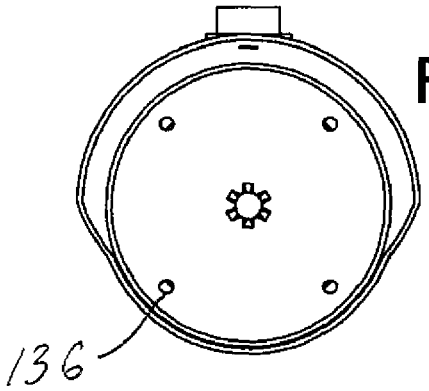
Figure 48:
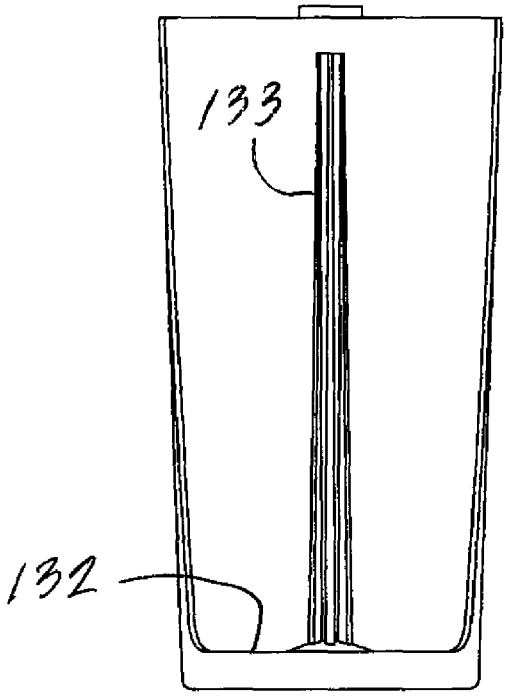
Figure 49:
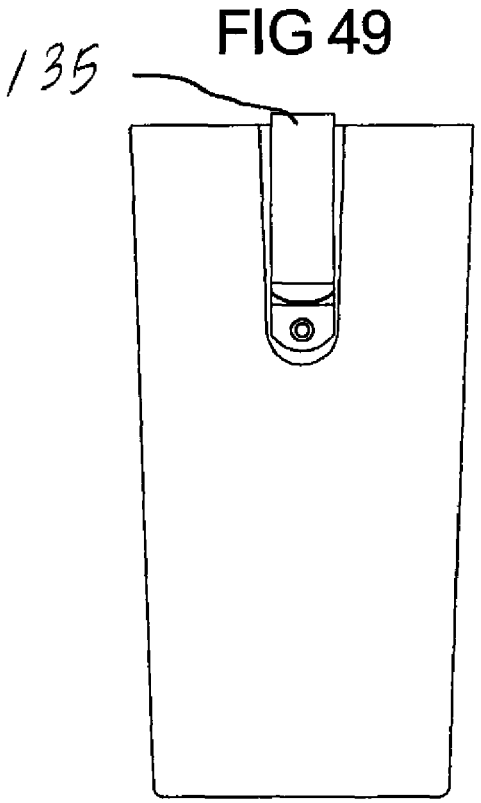
Figure 50:
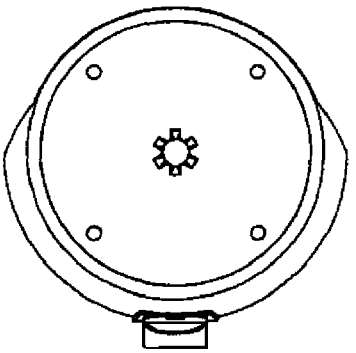

The portable dispenser 130 is provided with a clip 135 (as shown in FIGS. 44-50) and/or a loop device 137 (as shown in FIG. 51) for removably holding the dispenser 130 on the belt of the user. The dispenser 130 may hold a plurality of coils of roofing nails 134

The dispenser 130 may be provided with one or more drain holes 136.

While the present invention has been described in detail with reference to several specific embodiments thereof, it should be understood that these are described by way of illustration only, and not by way of limitation.

The present invention embraces all modifications, variations and changes which come within the scope of the patent claims set forth hereinbelow.

The invention claimed is:

1. A portable dispenser for strips of plastic collated nails arranged in a parallelogram so that the nails are parallel to each other with all nail points lying in one side of said parallelogram, comprising:

an open-topped container provided with a single unitary leaf spring to temporarily hold at least one strip of said collated nails and to make said strip of said collated nails readily accessible to a user of said portable dispenser;

a clip provided on an exterior surface of a back member of said open-topped container to removably and selectively temporarily attach said portable dispenser to a belt of the user of said portable dispenser;

said open-topped container has a substantially rectangular cross-section which is disposed substantially perpendicularly to a central vertical elongated axis of said open-topped container;

said open-topped container has a closed bottom formed by two bottom members disposed oblique to said central vertical elongated axis of said open-topped container and disposed at an angle relative to each other;

said open-topped container includes a front member which is parallel to and opposite to said back member of said open-topped container;

said front member and said back member each have a concave obtuse angle formed therein by said two oblique bottom members;

said portable dispenser includes identical right and left side members which interconnect said front member and said back member;

said portable dispenser is symmetrical relative to a plane disposed perpendicular to said front and back members and containing said central vertical elongated axis;

each said bottom member is angled in only one plane relative to said plane disposed perpendicular to said front and back members and containing said central vertical elongated axis;

said portable dispenser being designed, dimensioned and constructed so that each said strip of plastic collated nails is disposed completely within said open-topped container and is contiguous with one of said two oblique bottom members at the selection of the user to make the nails readily accessible to either desired hand of the user and from any desired position of said portable dispenser clipped to the belt of the user;

said a single unitary leaf spring is affixed at one, and only one, end thereof at an upper edge of said front member of said portable dispenser;

said single unitary leaf spring is disposed near a central portion of said open-topped container and is positioned to temporarily hold all of said strips of plastic collated nails completely within said open-topped container; and said front member, said back member, and said two oblique bottom members have lowermost edges which are disposed in a common plane that is oriented perpendicular to said plane disposed perpendicular to said front and back members and containing said central vertical elongated axis to enable said portable dispenser to stand upright unassisted on an external horizontal surface without tipping over.

* * * * *